United States Patent [19]

Chambley et al.

[11] 4,091,512

[45] May 30, 1978

[54] DEWEAVING APPARATUS FOR TEXTILE TAPES

[75] Inventors: Phillip Wayne Chambley; Alan Hedley Norris; Robert Doyal Frazier; Dwain Edwin Cromer, all of Rome, Ga.

[73] Assignee: Champion International Corporation, Stamford, Conn.

[21] Appl. No.: 696,305

[22] Filed: Jun. 15, 1976

[51] Int. Cl.[2] ..... D02G 1/00

[52] U.S. Cl. ..... 28/171; 28/187; 28/218; 200/61.13; 226/97

[58] Field of Search ..... 26/17; 28/17, 51, 72.16, 28/171, 218, 187, 72.6; 139/370.2; 200/61.13, 61.14, 61.18; 226/7, 10, 97; 19/.21, .23, .26; 250/548, 561, 571

[56] References Cited

U.S. PATENT DOCUMENTS

| | | | |
|---|---|---|---|
| 1,449,293 | 3/1923 | Poetzsch | 26/17 |
| 1,900,400 | 3/1933 | Scott | 19/.23 |
| 3,043,991 | 7/1962 | Schneider et al. | 28/51 X |
| 3,059,309 | 10/1962 | Blanton | 28/51 X |
| 3,123,890 | 3/1964 | Thompson | 28/51 |
| 3,158,852 | 11/1964 | Schacher | 28/51 X |
| 3,487,181 | 12/1969 | Bourgault et al. | 19/.23 UX |
| 3,605,225 | 9/1971 | Gibson et al. | 28/72.16 |
| 3,763,483 | 10/1973 | Urmenyi | 200/61.13 X |
| 3,880,198 | 4/1975 | Vermeulen | 139/370.2 X |
| 3,930,357 | 1/1976 | Gibson | 28/72.16 X |
| 3,951,321 | 4/1976 | Heusser | 226/97 |
| 4,015,314 | 4/1977 | Hurst et al. | 28/72.16 X |

FOREIGN PATENT DOCUMENTS

| | | | |
|---|---|---|---|
| 609,069 | 11/1960 | Canada | 200/61.13 |
| 855,454 | 2/1940 | France | 28/51 |
| 364,116 | 10/1938 | Italy | 28/51 |

*Primary Examiner*—Robert R. Mackey
*Attorney, Agent, or Firm*—Evelyn M. Sommer

[57] ABSTRACT

A deweaving apparatus for deweaving a fabric tape by separating and removing a weft filling yarn from a plurality of warp yarns. Control means are provided for sensing breakage of the warp yarns and weft yarn, as well as knots, splices and tangles in the tape, and in response to any such condition in the tape, stops the operation of the apparatus. Along with these means of automating the deweaving process, and greatly reducing operator attention required, a special divergence guide is fitted which accelerates loosening of the weft yarn over a very short path, thereby providing significant reduction in floor space required for the deweaving process.

8 Claims, 5 Drawing Figures

DEWEAVING APPARATUS FOR TEXTILE TAPES

BACKGROUND OF THE INVENTION

1. Field of the Invention

This invention relates to an apparatus for deweaving a fabric tape into individual strands so they may be wound on separate packages for subsequent use. Deweaving the tape is an essential process when space dyeing of textile yarns is carried out via the weave-de-weave process, since the tapes themselves cannot be used as a unit for further processing.

2. Description of the Prior Art

U.S. Pat. No. 3,605,225 describes in detail a weaving process which is commonly referred to as "weave-de-weave". Weft is inserted by a needle on a narrow width needle loom and knitted in a chain stitch along one side of a tape fabric including a plurality of warp threads in order that the weft can subsequently be removed after treatment of the fabric, e.g., by coloring, and the fabric unravelled to provide a yarn with intermittent coloring or splotches which is then used as pile yarn in carpets.

As the weft is removed, the individual warp yarns from the tape are separated out and wound on single one-end packages.

Typically, the yarn used for the weft filling is either nylon or polyester of a size substantially smaller than the warp yarn through which it is woven. For purposes of economy, the weft yarn must be reclaimed for repetitive use and with each re-use, the cost of the weft per pound of carpet yarn produced is decreased. However, there are serious drawbacks in re-using the weft yarn. Owing to its fine denier and to repeated subjection to both heat (during dyeing) and stress (during weaving and deweaving), the efficiency of the latter operations decreases with each re-use.

One problem associated with weft removal in the "weave-de-weave" process, therefore, is breakage of the weft thread or the presence of a knot or tangle in the weft thread as it is deweaved. This problem is compounded by the method of weft collection in which the use of a conventional ring traveler take-up is involved, which inserts variable twist in the weft end, consequently increasing the incidence of breakage and snarls in re-use of the weft. If the weft breaks or tangles, the de-weaving process must stop. Broken ends must be rethreaded and repaired, and yarn tensions readjusted, all of which gives rise to considerable process inefficiency and additionally requires operator attention.

Knots and tangles, as well as breakage, of the warp threads in the process is also a problem because of the simultaneous winding of a large number of parallel yarns onto separate packages. If a knot, tangle, or breakage of a warp thread occurs, the individual warp threads cannot be properly separated, and the entire process must stop.

Accordingly, because of the possibility of breakage and knots or tangles of the warp and weft yarns, such conditions must be quickly detected in the deweaving process and the deweaving apparatus stopped, so that appropriate corrective action can be taken before a broken yarn, by becoming entangled with adjacent yarns, creates numerous additional yarn breaks and tangles.

SUMMARY OF THE INVENTION

This is accomplished by providing a number of condition sensors and controls at various locations in the deweaving apparatus.

One control includes a pivotable gate which has a lower edge positioned at a predetermined height above a tape pull roller. If a knot or tangle is present in the tape, the gate will sense the increased thickness of the tape and swing or pivot, activating a microswitch, stopping the apparatus.

A conventional yarn aspirator is used to strip the weft from the warp yarns. A weft presence detector including a light-emitting diode (LED) and photocell is located near the aspirator in the weft threadline plane. If the weft thread breaks, the photocell will activate a relay stopping the apparatus. If the weft fails to deweave due to a knot or tangle, the travel of the warp tape would carry the weft end above its normal threadline plane also stopping the deweaving apparatus. Should the weft only momentarily snag, the absence of the weft in the threadline plane would stop the apparatus as stated, but if the weft meanwhile comes free, it would relocate itself back in the threadline plane, thus re-starting the take-up with no operator attention required.

In order to detect warp end breakage, the warp threads are fed through a hinged reed having upright fingers between which individual threads pass. A broken end will no longer be pulled by its take-up spindle, but will be carried along by the adjacent warp threads and pile up behind the reed. The drag on the excess yarn simply pushes the reed over, causing the activation of a microswitch to stop the apparatus.

BRIEF DESCRIPTION OF THE DRAWINGS

Further objects and advantages of the invention will become more apparent from the following description and claims, and from the accompanying drawings, wherein:

DETAILED DESCRIPTION OF THE PREFERRED EMBODIMENT

Figure 1:
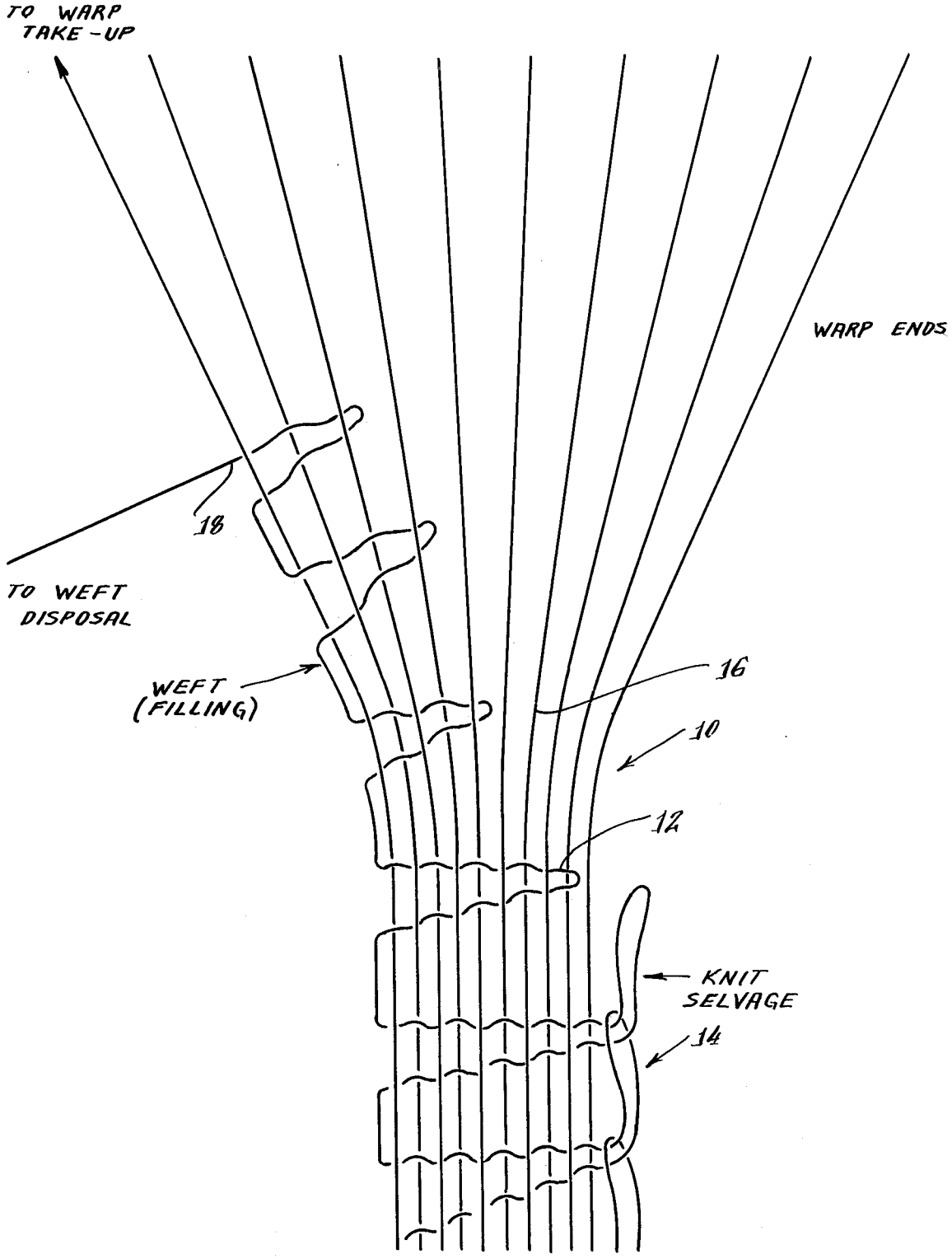
FIG. 1 is a top plan view of a typical "weave-de-weave" tape whose weft yarn is being deweaved by the apparatus of the present invention.
Figure 3:
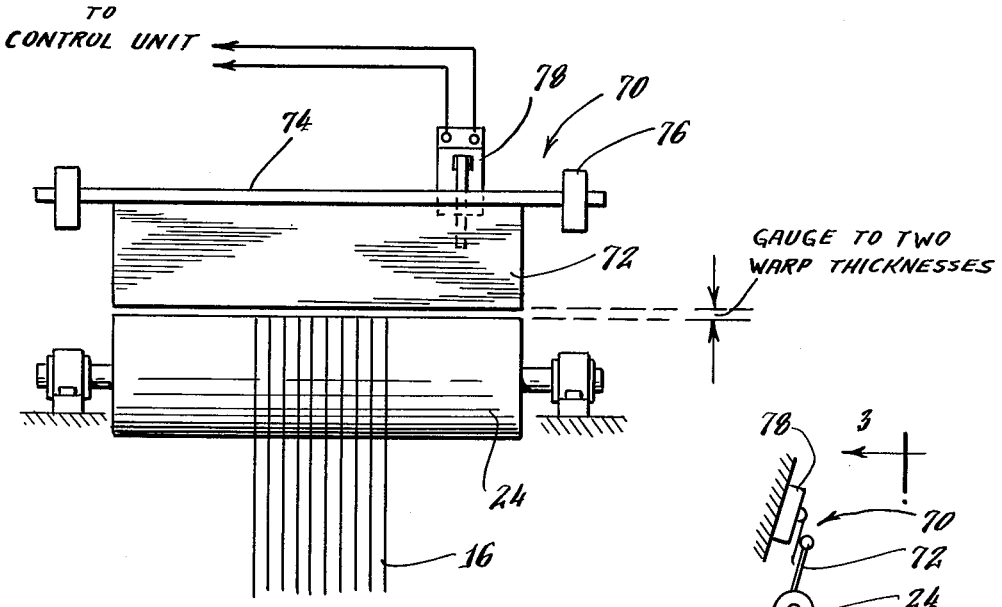
FIG. 3 is a side view in elevation of a portion of the apparatus of FIG. 2, taken substantially along the plane indicated by line 3—3 of FIG. 2.
Figure 2:
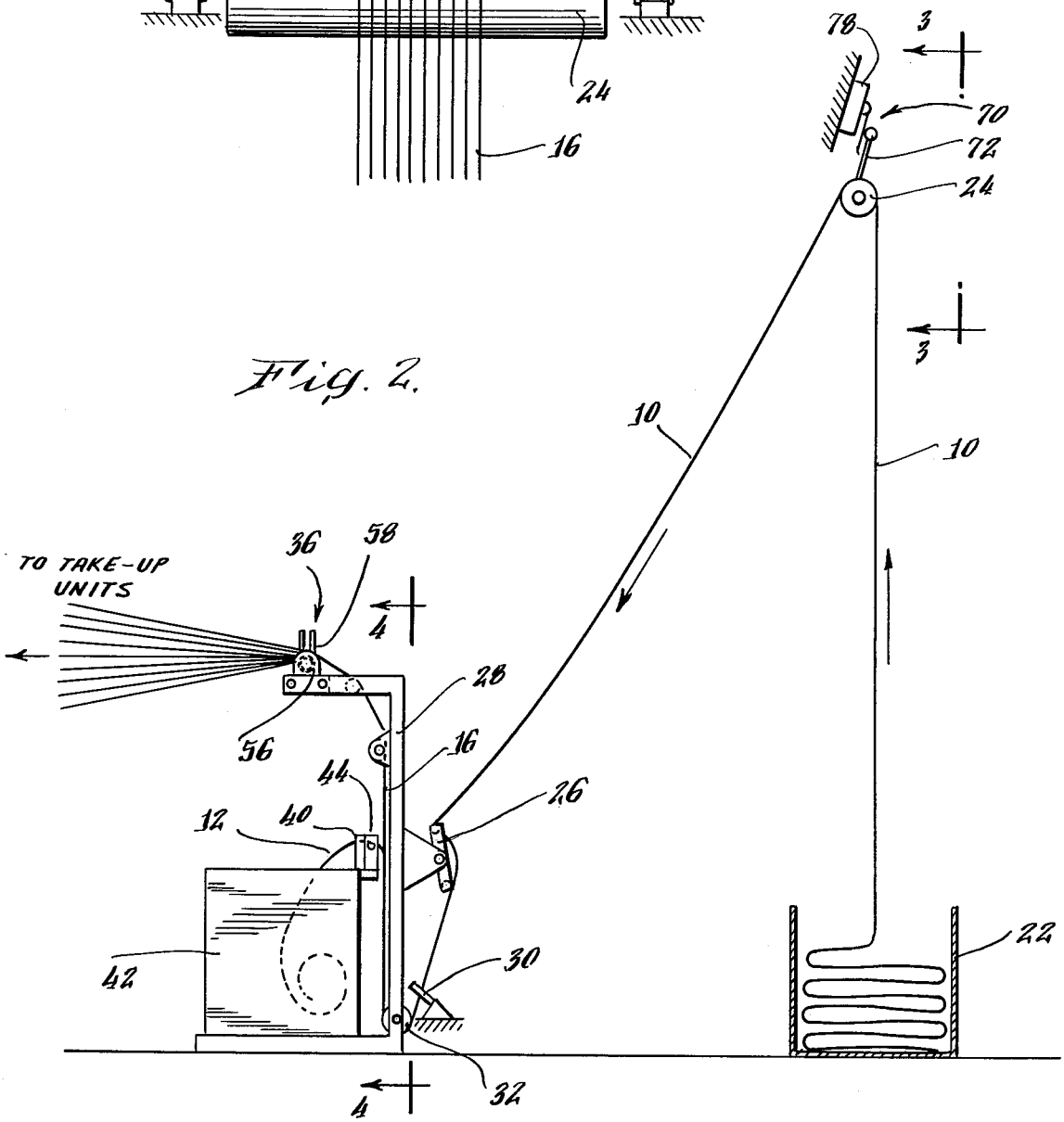
FIG. 2 is a front view in elevation of the deweaving apparatus of the present invention.

Referring now to the drawings in detail wherein like numerals indicate like elements throughout the several views, FIG. 1 illustrates a typical fabric tape 10 formed in a "weave-de-weave" process on a narrow width needle loom.

Weft filling 12 is inserted by a needle and knitted in a chain stitch 14 along one side of the tape fabric between a plurality of warp threads 16 to form a unitary selvage. After treatment of the fabric tape 10, e.g., by dyeing, the weft 12 is unwoven and removed by pulling on end 18 to unravel the picks as shown in the drawing. The chain stitch selvage 14 enables ready removal of the weft 12. The warp threads 16 are wound into individual packages for reworking, and the weft 12 is collected in a suitable receptacle for reuse or disposal.

FIGS. 2 to 5, inclusive, illustrate an apparatus 20 for deweaving the fabric tape 10.

The tape 10 is taken from a container 22 and wound about a tape pull roller 24. The tape 10 then travels down through a tension bar 26 pivotally mounted on a frame 28 and a tape guide 30, and is wound around a roller 32 rotatably mounted in bearings 34 on frame 28 which permits change of direction of tape 10 without multiplying tape tension. Separation of the warp yarns 16 and weft 12 then takes place in a zone between roller 32 and a pivotable reed mechanism 36 mounted on top of frame 28, which is illustrated in greater detail in FIG. 4.

Figures 4, 5:
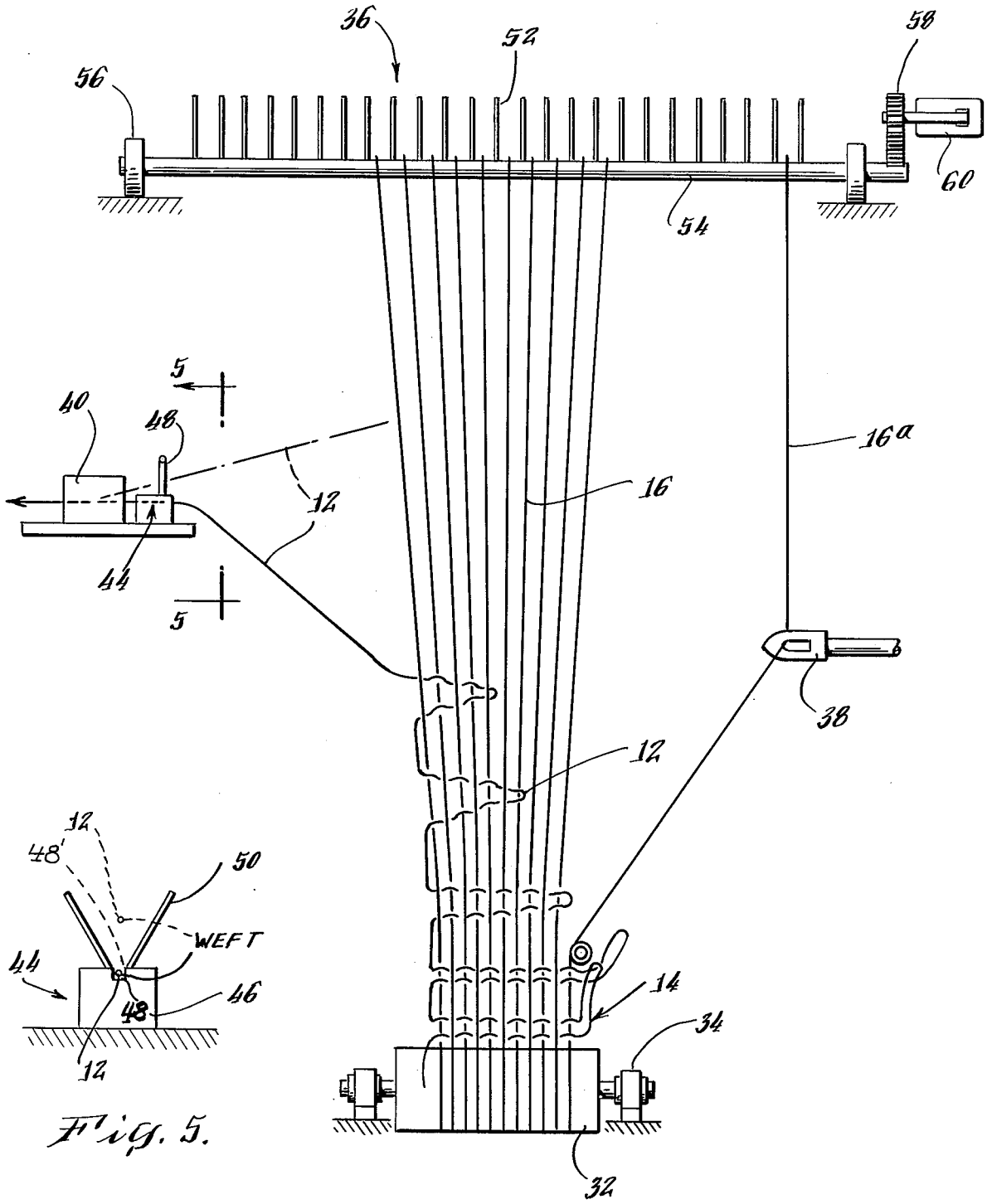
FIG. 4 is a side view in elevation of another portion of the apparatus of FIG. 2, taken substantially along the plane indicated by line 4—4 of FIG. 2.
FIG. 5 is a view in elevation of a portion of the apparatus of FIG. 4, taken substantially along the plane indicated by line 5—5 of FIG. 4.

As shown in FIG. 4, to insure deweaving of the weft selvage 14, a spreader guide 38 draws out the first warp thread 16*a*, effectively increasing the divergence angle of the splitting warp, pulling the weft filling 12 from the warp. An ordinary yarn aspirator 40 is mounted in the deweaving zone for pulling the weft 12 out of the warp, which can be deposited in a container 42 for remelting and subsequent extrusion into new weft yarn. Alternatively, the weft can be wound into a reusable thread package by a conventional travelling ring take-up mechanism.

A weft presence detector 44 which includes a light emitting diode in a housing 46 and a light collector, such as a photocell, is mounted just in advance of the aspirator 40. The weft 12 is positioned in a slot 48' in housing 46 to define a threadline plane intersecting the light beam from the diode to the photocell. If the weft thread 12 breaks, the photocell receives light from the diode and will emit an electrical signal to trip a relay stopping the deweaving apparatus 20 by shutting down the motor driving the take-up units or spindles for the warp yarns 16, so the break can be repaired by rethreading the weft 12 through the aspirator 40.

If the weft fails to deweave due to a knot or tangle, the travel of the warp tape will carry the weft end upwards and out of the threadline plane as indicated by the phantom lines in FIG. 4 and FIG. 5, which will also shut down the deweaving apparatus. If the weft only momentarily snags, the weft end's absence in the threadline plane would disconnect the driving voltage to the take-up units, as before, but if the weft meanwhile came free due to the pulling of aspirator 40, diverging fingers 48 and 50 would guide its re-entry back into the normal threadline plane and light path thus restarting the take-up units without operator attention.

In the event of warp end breakage, the broken end of the warp thread is no longer pulled by its take-up spindle, but is carried along by its unbroken neighbors between a pair of upright fingers 52 fixed to reed shaft 54 pivotally mounted in bushings 56 on frame 28. The broken loose end piles up behind the reed 36 until its forward drag is sufficient to pivot shaft 54 forwardly. An upright arm 58 on the end of shaft 54 will activate a microswitch 60 to stop the drive of the take-up units so that appropriate repairs can be made.

A control 70 is also provided to sense knots and splices in the tape 10. Obviously, if two tapes are joined together in container 22 either with a knot or a full tape splice, individual warp ends cannot be separated.

Control 70 includes a gate 72 fixed to a shaft 74 rotatably mounted in bushings 76. The bottom edge of gate 72 is spaced about two warp thread thicknesses above roller 24. A splice or knot of greater thickness in tape 10 will pivot gate 72 in bushings 76 to close a microswitch 78 to stop the take-up spindle drive until the sensed condition is repaired.

By use of the weft and warp controls on the deweaving apparatus, significant downtime of the apparatus is avoided.

What we claim as new is:

1. In a deweaving apparatus for deweaving a fabric tape by separating and removing a weft filling yarn from a plurality of warp yarns, the improvement comprising:

means for sensing breakage of said warp yarns, means for sensing breakage of said weft filling yarn, means for sensing knots and splices in said fabric tape, and means for stopping the operation of said deweaving apparatus in response to any of said sensed conditions by each of said sensing means, said means for sensing breakage of said warp yarns including a reed pivotable in response to sensing an excess mass of warp yarn passing therethrough, said reed having a plurality of upright fingers fixed to a pivotable shaft between any two of which a single warp yarn is passed, an arm mounted directly on the end of said pivotable shaft, and said operation stopping means including switch means for stopping operation of said deweaving apparatus in response to direct contact with said arm upon pivoting of said shaft.

2. In an apparatus in accordance with claim 1, said means for sensing breakage of said weft filling yarn including a weft presence detector including a housing having a slot defining a weft threadline plane through which said weft yarn passes, and said operation stopping means including means for detecting the presence or absence of said weft yarn in said weft threadline plane and in response to the absence thereof, stopping operation of said deweaving apparatus,

3. In an apparatus in accordance with claim 2, said means for sensing knots and splices in said fabric tape including a roller about which said tape is wound, a gate including an elongated plate having a bottom edge rotatably mounted above said roller in a predetermined spaced relation to said roller and pivotable in response to sensing a tape between said roller and the bottom edge of said gate of a thickness in excess of said predetermined spaced relationship, and said operation stopping means including switch means for stopping operation of said deweaving apparatus in response to direct contact with said plate upon pivoting of said plate by said tape.

4. In an apparatus in accordance with claim 3, including a guide member adjacent to but spaced from said warp yarn in a deweaving zone receiving therethrough one of said warp yarns to spread the warp of said fabric tape to accelerate removal of the weft filling yarn therefrom.

5. In a deweaving apparatus for deweaving a fabric tape by separating and removing a weft filling yarn from a plurality of warp yarns, the improvement comprising:

means for sensing breakage of said warp yarns, means for sensing breakage of said weft filling yarn, means for sensing knots and splices in said fabric tape, and means for stopping the operation of said deweaving apparatus in response to any of said sensed conditions by each of said sensing means, said means for sensing breakage of said weft filling yarn including a weft presence detector including a housing having a slot defining a weft threadline plane through which said weft yarn passes, and said operation stopping means including means for detecting the presence or absence of said weft yarn in said weft threadline plane and in response to the absence thereof, stopping operation of said deweaving apparatus, said housing including a pair of diverging upright fingers above said threadline plane for guiding the re-entry of said weft during temporary snags in said weft as it is pulled by said warp yarns.

6. In an apparatus in accordance with claim 5 wherein said detecting means includes a light emitting diode adjacent said thread-line plane and photocell responsive to changes in light from said diode to stop operation of said deweaving apparatus.

7. In an apparatus in accordance with claim 5 including a yarn aspirator for pulling said weft through said threadline plane.

8. In a deweaving apparatus for deweaving a fabric tape by separating and removing a weft filling yarn from a plurality of warp yarns, the improvement comprising:

means for sensing breakage of said warp yarns, means for sensing breakage of said weft filling yarn, means for sensing knots and splices in said fabric tape, and means for stopping the operation of said deweaving apparatus in response to any of said sensed conditions by each of said sensing means, said means for sensing knots and splices in said fabric tape including a roller about which said tape is wound, a gate including an elongated plate having a bottom edge rotatably mounted above said roller in a predetermined spaced relation to said roller and pivotable in response to sensing a tape between said roller and the bottom edge of said gate of a thickness in excess of said predetermined spaced relationship, and said operation stopping means including switch means for stopping operation of said deweaving apparatus in response to direct contact with said plate upon pivoting of said plate by said tape.

* * * * *